US006513608B2

(12) United States Patent
Eyre et al.

(10) Patent No.: US 6,513,608 B2
(45) Date of Patent: Feb. 4, 2003

(54) CUTTING ELEMENTS WITH INTERFACE HAVING MULTIPLE ABUTTING DEPRESSIONS

(75) Inventors: Ronald K. Eyre, Orem, UT (US); Christopher A. Tucker, Orem, UT (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/780,825

(22) Filed: Feb. 9, 2001

(65) Prior Publication Data

US 2002/0108791 A1 Aug. 15, 2002

(51) Int. Cl.[7] ..... E21B 10/46
(52) U.S. Cl. ..... 175/430; 175/431; 175/433
(58) Field of Search ..... 175/425, 428, 175/430, 431, 434, 426, 432

(56) References Cited

U.S. PATENT DOCUMENTS

| | | | |
|---|---|---|---|
| 4,109,737 | A | 8/1978 | Bovenkerk |
| 4,764,434 | A | 8/1988 | Aronsson et al. |
| 4,784,023 | A | 11/1988 | Dennis |
| 4,972,637 | A | 11/1990 | Dyer |
| 4,997,049 | A | 3/1991 | Tank et al. |
| 5,011,515 | A | 4/1991 | Frushour |
| 5,037,451 | A | 8/1991 | Burnand et al. |
| 5,217,081 | A | 6/1993 | Waldenström et al. |
| 5,351,772 | A | 10/1994 | Smith |
| 5,355,969 | A | 10/1994 | Hardy et al. |
| 5,379,854 | A | 1/1995 | Dennis |
| 5,469,927 | A | 11/1995 | Griffin |
| 5,484,330 | A | 1/1996 | Flood et al. |
| 5,486,137 | A | 1/1996 | Flood et al. |
| 5,494,477 | A | 2/1996 | Flood et al. |
| 5,544,713 | A | 8/1996 | Dennis |
| 5,564,511 | A | 10/1996 | Frushour |
| 5,566,779 | A | 10/1996 | Dennis |
| 5,590,728 | A | 1/1997 | Matthias |
| 5,598,750 | A | 2/1997 | Griffin et al. |
| 5,605,199 | A | 2/1997 | Newton |
| 5,611,649 | A | 3/1997 | Matthias |
| 5,617,928 | A | 4/1997 | Matthias et al. |
| 5,622,233 | A | 4/1997 | Griffin |
| 5,662,720 | A | 9/1997 | O'Tighearnaigh |
| 5,669,271 | A | 9/1997 | Griffin et al. ..... 76/108.2 |
| 5,709,279 | A | 1/1998 | Dennis ..... 175/430 |
| 5,711,702 | A | 1/1998 | Devlin ..... 451/540 |
| 5,816,347 | A | 10/1998 | Dennis et al. ..... 175/432 |
| 5,871,060 | A | 2/1999 | Jensen et al. ..... 175/420.2 |
| 5,881,830 | A | 3/1999 | Cooley ..... 175/428 |
| 5,888,619 | A | 3/1999 | Griffin ..... 428/172 |
| 5,906,246 | A | 5/1999 | Mensa-Wilmot et al. ... 175/432 |
| 5,971,087 | A | 10/1999 | Chaves ..... 175/432 |
| 5,979,577 | A | 11/1999 | Fielder ..... 175/431 |
| 6,000,483 | A | 12/1999 | Jurewicz et al. ..... 175/428 |

(List continued on next page.)

FOREIGN PATENT DOCUMENTS

| | | |
|---|---|---|
| EP | 0687797 | 12/1995 |
| EP | 0893572 | 1/1999 |
| GB | 2270493 | 3/1994 |
| GB | 2329405 | 3/1999 |

*Primary Examiner*—Frank S. Tsay
(74) *Attorney, Agent, or Firm*—Christie, Parker & Hale, LLP

(57) ABSTRACT

Cutting elements for incorporation in a drill bit are provided having a body and an ultra hard material cutting layer over an end face of the body. A plurality of abutting shallow depressions are formed on the end face of the body. A transition layer may be incorporated between the body and the ultra hard material layer. The transition layer preferably has material properties intermediate between the properties of the body and the ultra hard material layer.

44 Claims, 9 Drawing Sheets

U.S. PATENT DOCUMENTS

| | | | | | |
|---|---|---|---|---|---|
| 6,011,232 | A | | 1/2000 | Matthias | 219/69.17 |
| 6,065,554 | A | * | 5/2000 | Taylor et al. | 175/430 |
| 6,098,730 | A | * | 8/2000 | Scott et al. | 175/432 |
| 6,102,143 | A | | 8/2000 | Snyder et al. | 175/432 |
| 6,148,937 | A | | 11/2000 | Mensa-Wilmot et al. | 175/428 |
| 6,196,340 | B1 | | 3/2001 | Jensen et al. | 175/431 |
| 6,196,910 | B1 | | 3/2001 | Johnson et al. | 451/540 |
| 6,199,645 | B1 | | 3/2001 | Anderson et al. | 175/426 |
| 6,202,771 | B1 | | 3/2001 | Scott et al. | 175/432 |
| 6,202,772 | B1 | | 3/2001 | Eyre et al. | 175/432 |
| 6,244,365 | B1 | * | 6/2001 | Southland | 175/432 |

* cited by examiner

CUTTING ELEMENTS WITH INTERFACE HAVING MULTIPLE ABUTTING DEPRESSIONS

FIELD OF THE INVENTION

This invention relates to cutting elements used in earth boring bits for drilling earth formations. Specifically this invention relates to cutting elements having a non-planar interface including a plurality of shallow abutting depressions between their substrate and their cutting layer.

BACKGROUND OF THE INVENTION

A typical cutting element is shown in FIG. 1. The cutting element typically has cylindrical cemented carbide substrate body 2 having an end face 3 (also referred to herein as an "upper surface" or "interface surface"). An ultra hard material layer 4, such as polycrystalline diamond or polycrystalline cubic boron nitride, is bonded on to the upper surface forming a cutting layer. The cutting layer can have a flat or a curved upper surface 5.

Generally speaking the process for making a compact employs a body of cemented tungsten carbide where the tungsten carbide particles are cemented together with cobalt. The carbide body is placed adjacent to a layer of ultra hard material particles such as diamond of cubic boron nitride (CBN) particles and the combination is subjected to high temperature at a pressure where diamond or CBN is thermodynamically stable. This results in recrystallization and formation of a polycrystalline diamond or polycrystalline cubic boron nitride layer on the surface of the cemented tungsten carbide. This ultra hard material layer may include tungsten carbide particles and/or small amounts of cobalt. Cobalt promotes the formation of polycrystalline diamond or polycrystalline cubic boron nitride and if not present in the layer of diamond or CBN, cobalt will infiltrate from the cemented tungsten carbide substrate.

The problem with many cutting elements is the development of cracking, spalling, chipping and partial fracturing of the ultra hard material cutting layer at the layer's region subjected to the highest impact loads during drilling especially during aggressive drilling. To overcome these problems, cutting elements have been formed having a non-planar substrate interface surface 3 which is defined by forming a plurality of spaced apart grooves or depressions that are relatively deep in that they typically have a depth that is greater than 10% of the cutting element diameter. Applicants have discovered that these deep grooves or depression cause the build-up of high residual stresses on the interface surface leading to premature interfacial delamination of the ultra hard material layer from the substrate. Delamination failures become more prominent as the thickness of the ultra hard material layer increases. However, the impact strength of the ultra hard material layer increases with an increase in the ultra hard material layer thickness.

Consequently, a cutting element is desired that can be used for aggressive drilling and which is not subject to early or premature failure, as for example by delamination of the ultra hard material layer from the substrate, and which has sufficient impact strength resulting in an increased operating life.

SUMMARY OF THE INVENTION

The present invention provides for cutting elements which are mounted in a bit body. An inventive cutting element has an increased thickness of the ultra hard material cutting layer at its critical edge, while at the same time having a reduced tendency for delamination of the ultra hard material layer from the substrate. The critical edge of the cutting element is the portion of the edge of the cutting layer that comes in contact with the earth formations during drilling and is subject to the highest impact loads.

The inventive cutting element substrate interface surface over which is formed the ultra hard material cutting layer comprises a plurality of abutting shallow depressions. These depressions preferably span at least 20% of the interface substrate surface and extend to the periphery of the substrate coincident with the critical edge. The depressions may span the entire interface surface.

In one embodiment, a cutting element of the present invention comprises an interface surface that may be flat, convex i.e., dome shaped, or concave. A plurality of abutting shallow depressions are formed on the interface surface such the each shallow depression shares at least one side with another depression. Preferably each depression abuts at least two other depressions, i.e., each depression shares one side with a second depression and another side with a third depression. The depressions are preferably shallow in that their maximum depth is not greater than 5% and not less than 0.5% of the diameter of the cutting element. Moreover, the maximum width of each depression is not greater than 40% and not less than 1% of the diameter of the cutting element. In a preferred embodiment, the shallow depressions are concave in cross-section. Furthermore, with the exception of the depressions intersecting the periphery of the substrate, the remaining depressions are polygonal in shape when viewed from an axial direction of the cutting element. In other words, the sides of the depressions defining the depression perimeters are linear when viewed from an axial direction of the cutting element.

DETAILED DESCRIPTION OF THE INVENTION

Figure 1:
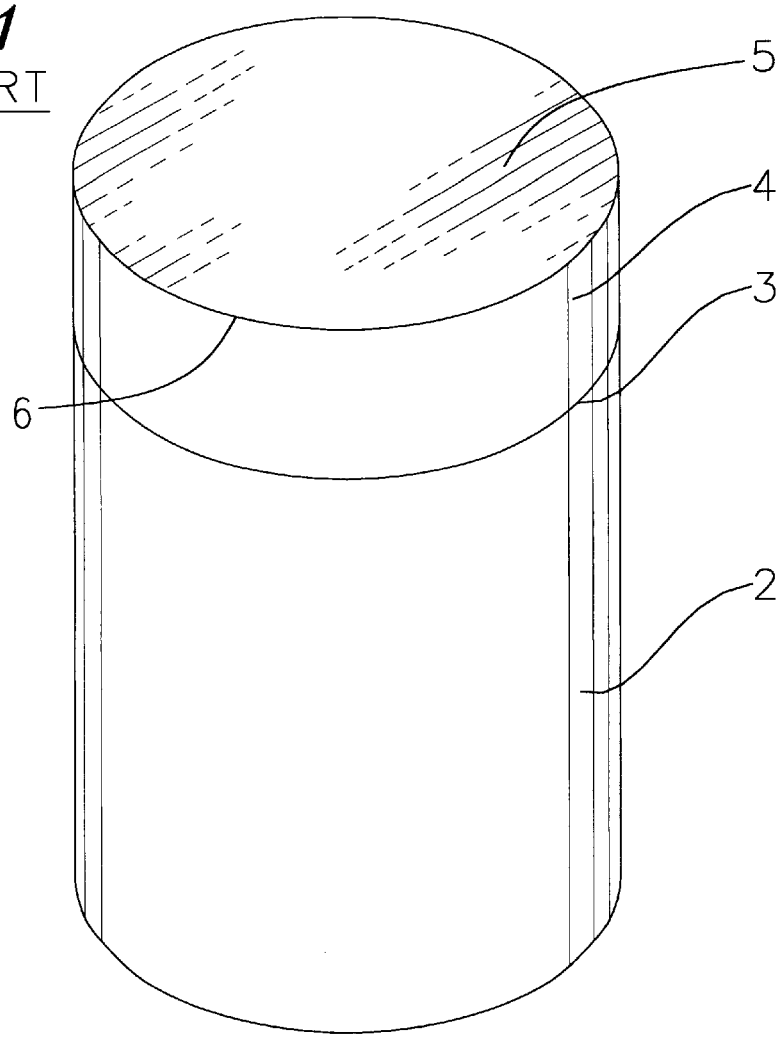
FIG. 1 PRIOR ART
FIG. 1 is a perspective view of a conventional cutting element.
Figure 2:
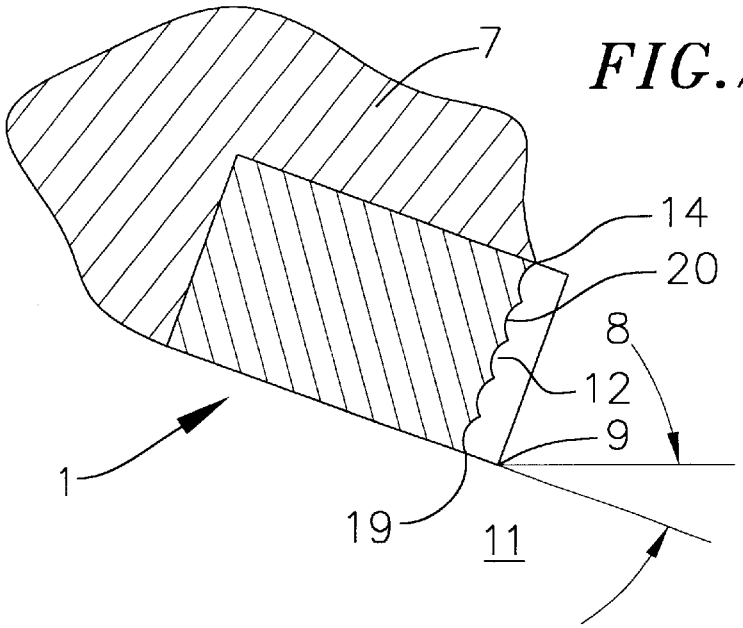
FIG. 2 is a partial cross-sectional view of a cutting element of the present invention mounted in a bit body and making contact with an earth formation during drilling.
Figure 3:
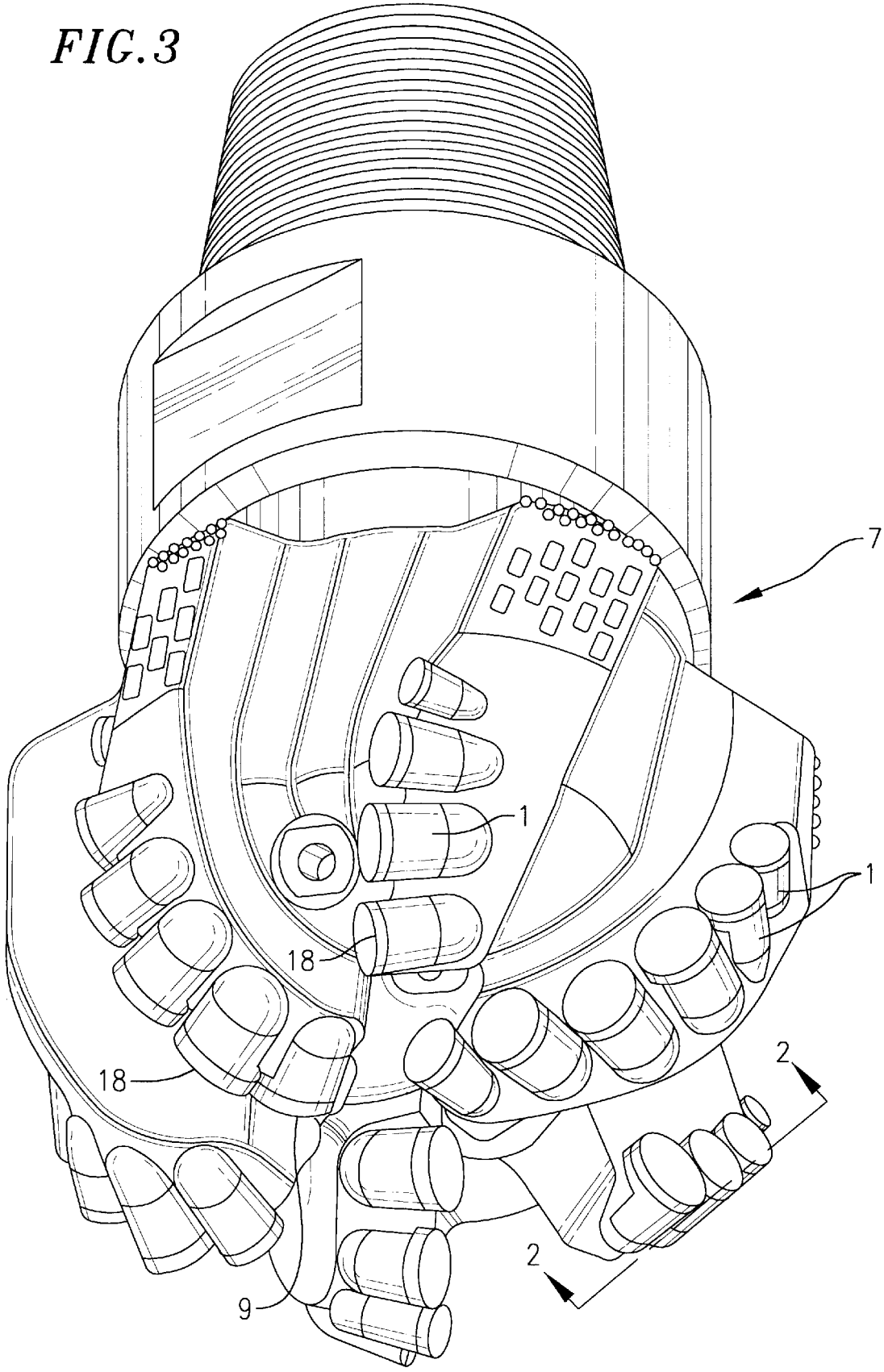
FIG. 3 is a perspective view of a bit body outfitted with the cutting elements of the present invention.

A cutting element 1 (i.e., insert) has a body (i.e., a substrate) 10 having an interface surface 12 (FIG. 2). The body is typically cylindrical having an end face forming the interface surface 12 and a cylindrical outer surface 16. A circumferential edge 14 is formed at the intersection of the interface surface 12 and the cylindrical outer surface 16 of the body. An ultra hard material layer 18 such a polycrystalline diamond or cubic boron nitride layer is formed on top of the interface surface of the substrate. The cutting elements of the present invention are preferably mounted in a drag bit 7 (as shown in FIG. 3) at a rake angle 8 (as shown in FIG. 2) and contact the earth formation 11 during drilling along an edge 9 (referred to herein for convenience as the "critical edge") of the cutting layer 18. Similarly, the body circumferential edge coincident with the critical edge is referred to herein for convenience as the "body critical edge" 19.

Figure 4B:
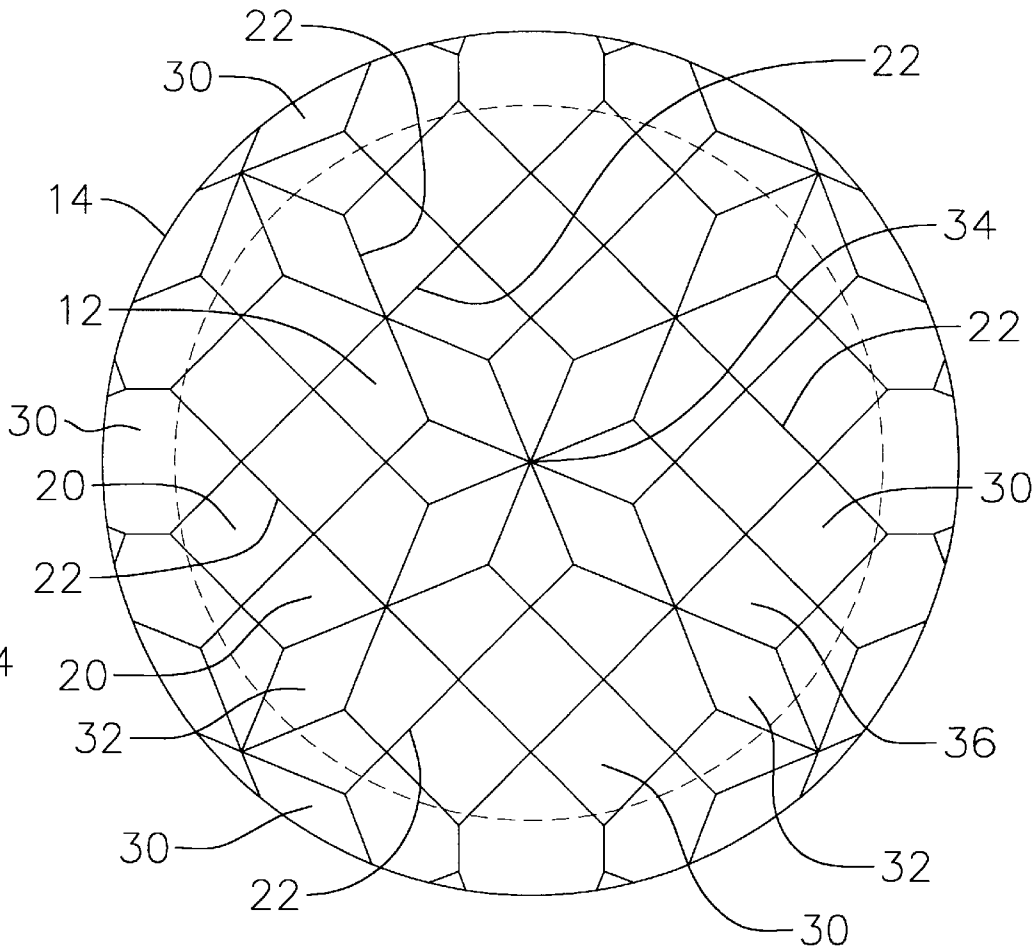
FIG. 4B is a top view of the cutting element substrate shown in FIG. 4A depicting the abutting shallow depressions formed thereon.
Figure 4A:
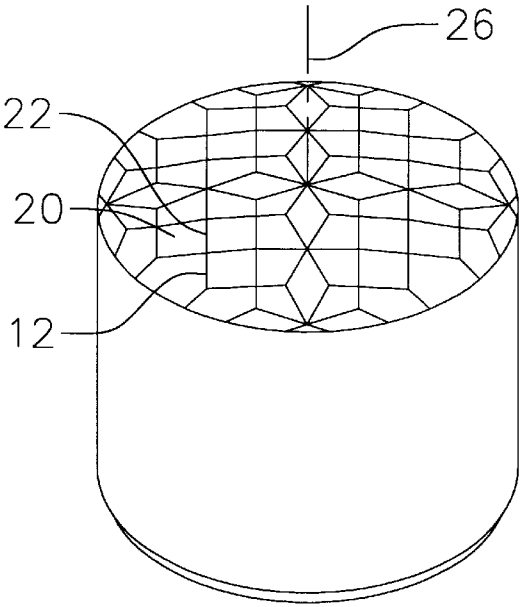
FIG. 4A is a perspective view of the substrate of a cutting element of the present invention.

A cutting element of the present invention has shallow abutting depressions 20 formed on the substrate interface surface 12 that interfaces with the cutting element ultra hard material layer (FIGS. 4A and 4C). The depressions are abutting in that each depression shares a depression perimeter side 22 with another depression. A depression perimeter side 22 (also referred to herein as a "ridge") is defined at the intersection between abutting depressions. By forming shallow abutting depressions on the substrate interface surface, the contact surface area between the ultra hard material layer and the substrate increases without introducing harmful residual stress components that become evident with deeper depressions. Furthermore, the, thickness of the ultra hard material layer increases as ultra hard material fills in the depressions. The increase in thickness is sufficient for improving the impact strength of the cutting element without materially increasing the risk for delamination.

Through testing applicants have discovered that the cutting elements of the present invention have a 20% increase in impact strength when compared to cutting elements having a smooth substrate interface surface. Applicants have also noted a slight improvement in impact strength when compared with cutting elements having deeper depressions formed on their substrate interface surface.

Figure 5:
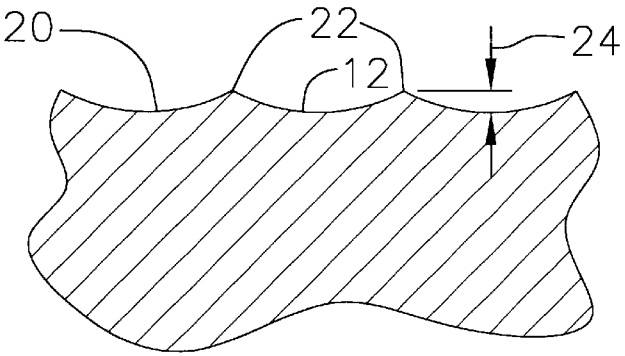
FIG. 5 is a partial cross-sectional view of a substrate of the present invention depicting the shallow depressions formed on the end surface of the substrate.
Figure 6:
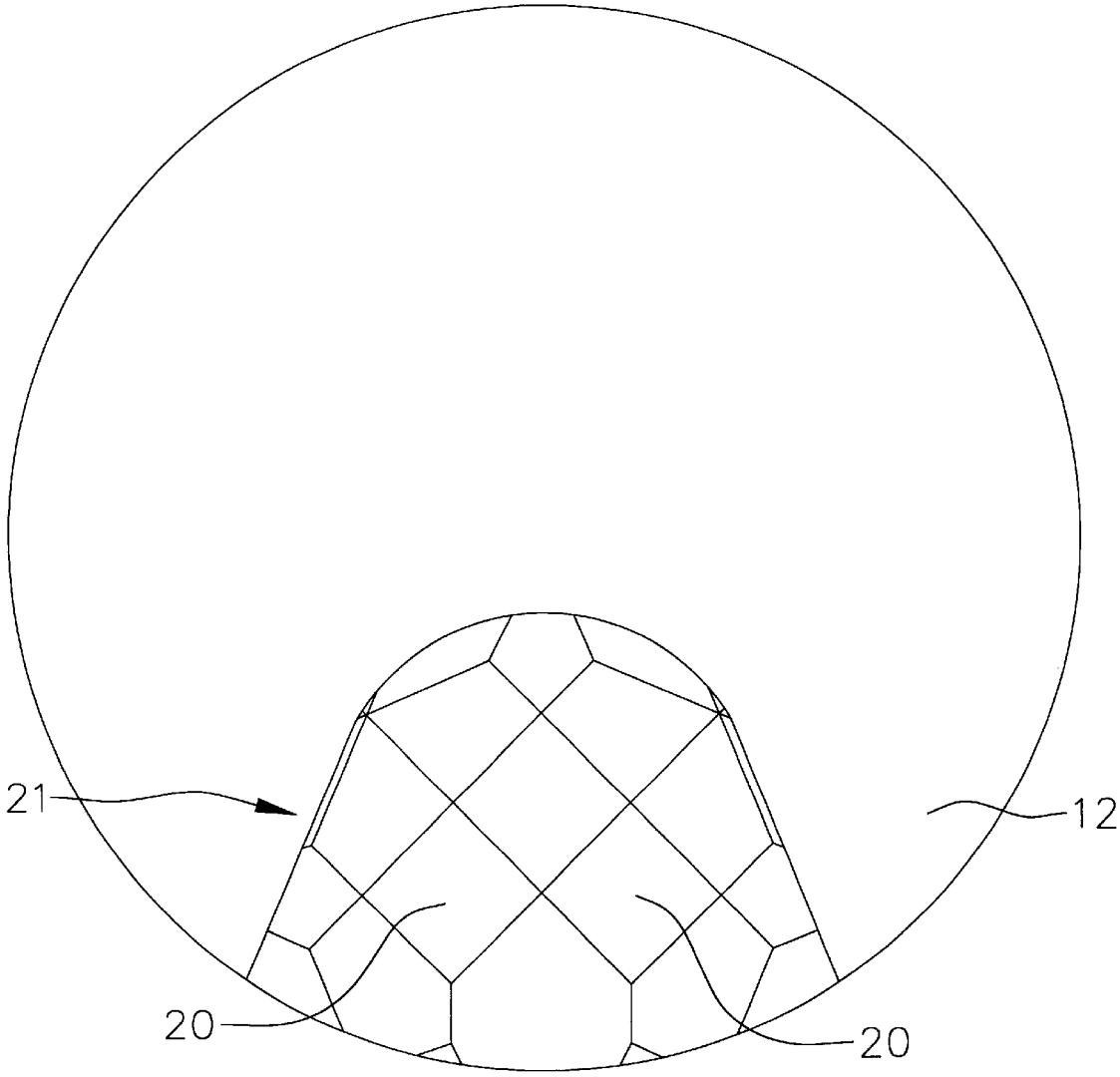
FIG. 6 is a top view of a substrate of a cutting element of the present invention having shallow depressions formed over a portion of the substrate interface surface.
Figure 8B:
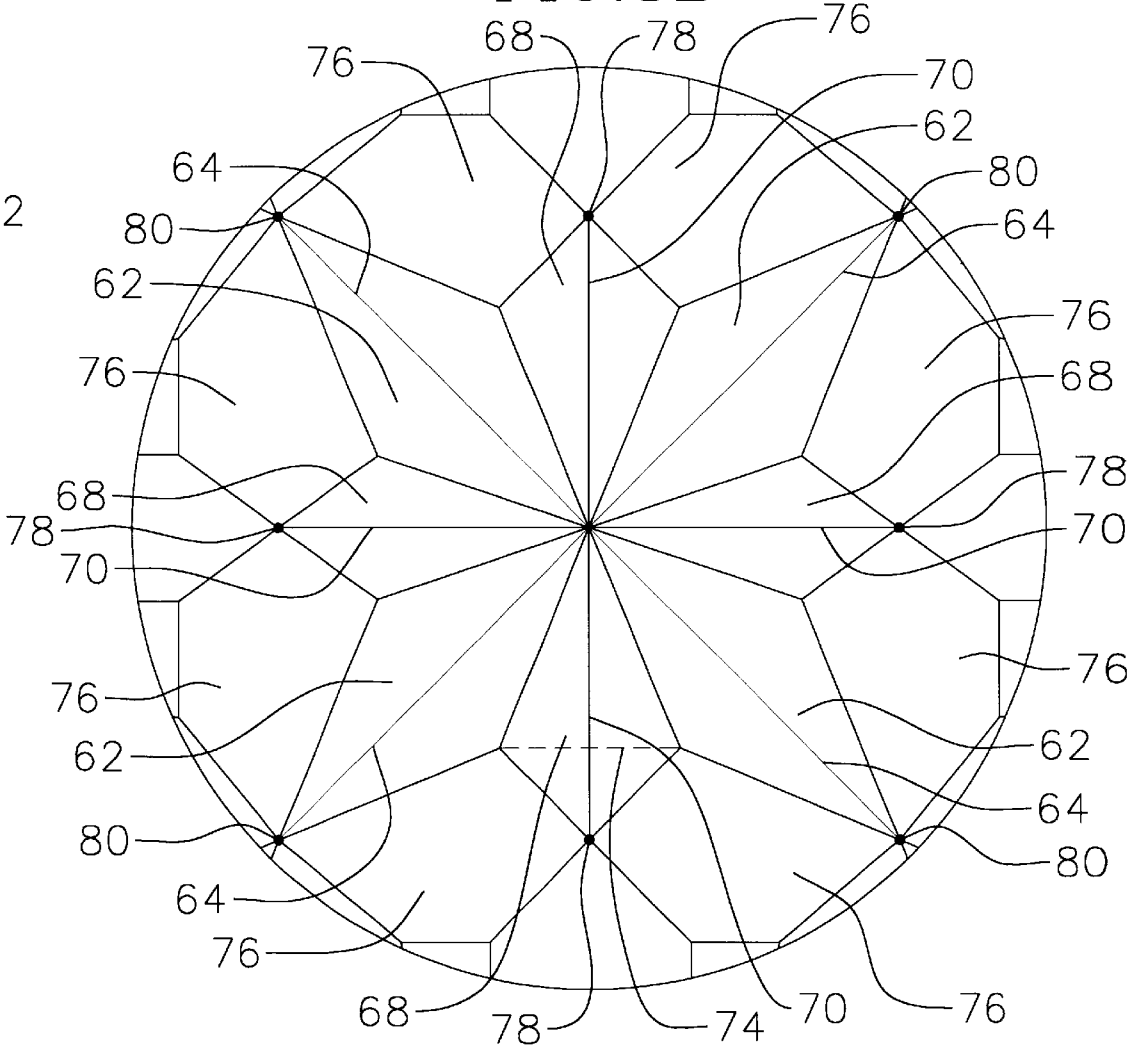
FIG. 8B is a top view of the cutting element substrate shown in FIG. 7A depicting the abutting shallow depressions formed thereon.

The depressions are shallow in that their maximum depth 24 is not greater than 5% and not less of 0.5% of the diameter of the cutting element. The depth 24 of each depression is measured from the top of a perimeter 22 of the depression, as shown in FIG. 5. The maximum width of each depression is preferably not greater than 40% and no less than 1% of the diameter of the substrate. Moreover, the depressions 20 occupy a portion 21 of the substrate interface surface 12 as shown in FIG. 6 or may occupy the entire interface surface as shown in FIGS. 4B and 8B. Preferably, the abutting depressions occupy at least 20% of the interface surface.

The depressions 20 are concave in cross-section. Moreover, with the exception of the depressions intersecting the circumferential edge 14 of the cutting element body (i.e., the substrate), the remaining depressions are polygonal in geometry when viewed from an axial direction 26 relative to the cutting element body. In other words, the perimeter sides 12 of the depressions are linear when viewed from an axial direction 26 relative to the cutting element body. However, the perimeter sides may be curved when viewed from their side.

The shallow depressions are preferably formed on the substrate interface surface by machining after formation of the substrate. The interface surface prior to machining may be flat, concave or convex. Alternatively, the shallow depressions may be formed during the process of forming the substrate by using an appropriate mold.

Two exemplary embodiments of cutting elements of the present invention are shown in FIGS. 4B and 8B respectively. In the embodiment shown in FIG. 4B, all the depressions 20 with exception of the depressions 30 that intersect the peripheral edge 14 of the substrate are quadrilateral, i.e., each depression is bounded by four straight perimeter sides 22 when viewed from an axial direction of the cutting element. Furthermore, with the exception of the depressions intersecting the circumferential edge 14 of the cutting element, each depression shares three of its perimeter sides with three other depressions. The shape of each depression as described herein is the plan shape of the depression when viewed from an axial direction 26 of the cutting element body.

As can be seen from FIG. 4B, the depressions formed on the substrate interface surface 12 comprise two rows of diamond shaped depressions 32. The two rows are orientated perpendicularly to each other and intersect the central axis 34 of the cutting element substrate. A plurality of depressions 36 having a quadrilateral shape substrate surround the diamond shape depressions.

Figure 7:
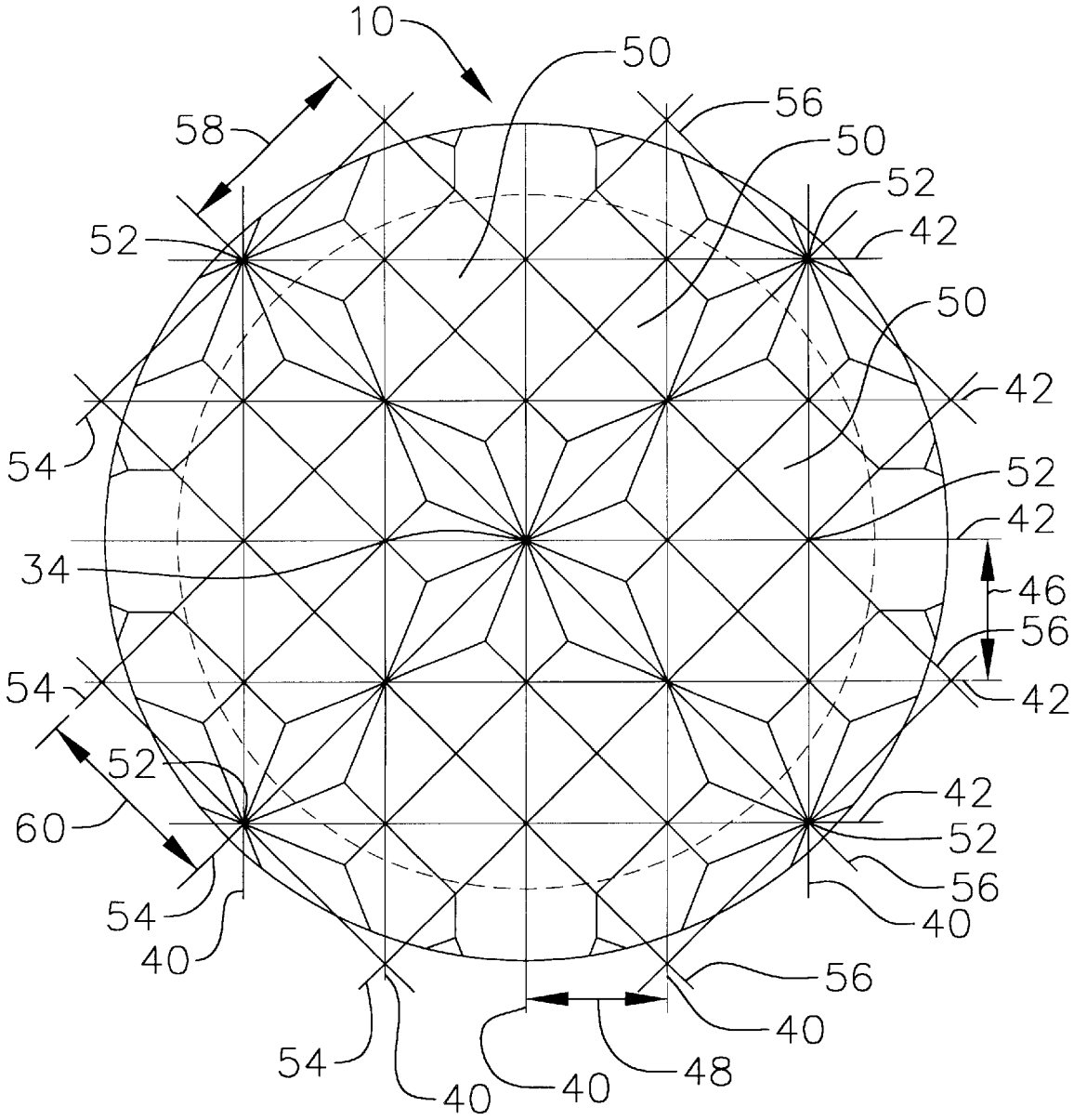
FIG. 7 is a top view of the substrate shown in FIG. 4A depicting the abutting shallow depressions formed thereon and further depicting the cutting tool paths for forming the depicted shallow depressions.

To form the depressions of the cutting element shown in FIG. 4B, a milling tool is used. The milling tool is moved to cut along a first set of linear, equidistantly spaced apart, parallel paths 40 along the substrate interface surface as shown in FIG. 7. The milling tool is then moved to cut along a second set of linear equidistantly spaced apart parallel paths 42 which are perpendicular to the first set of linear paths 40. The spacing 46 between subsequent second set paths is equal to the spacing 48 of subsequent first set paths. Consequently, a plurality of squares 50 are defined by the intersection of the two sets of paths. A path from each of the first and second sets of paths intersects the central axis 34 of the cutting element. Points of intersection 52 are defined at the intersections between the paths of the first set and the paths of the second set. Each of the defined squares 50 has four points of intersection 52 as its vertices.

A third set of cuts are made along a third set of equidistantly spaced apart parallel paths 54 oriented at 45° to the first set of paths. A path from the third set of paths intersects the central axis 34 of the cutting element. Each of the third set paths intersects at least one point of intersection 52 between paths from the first two sets. Adjacent paths 54 from the third set of paths intersect diagonally opposite vertices of a square 50.

A fourth set of cuts are made along a fourth set of equidistantly spaced apart parallel paths 56 oriented perpendicularly to the third set of paths. A path from the fourth set intersects the central axis 34 of the cutting element substrate 10. Each of the fourth set of paths intersects a point of intersection 52 between the first and second sets of paths. Moreover, the spacing 58 between subsequent paths of the fourth set is equal to the spacing 60 between subsequent paths of the third set. Each path from any set, intersects a path from each of the other sets at the same location. Each cut made along a path should be wide enough such that parallel adjacent cuts along the same set of paths overlap each other so as to define the perimeter sides 22 of the depressions.

Figure 8A:
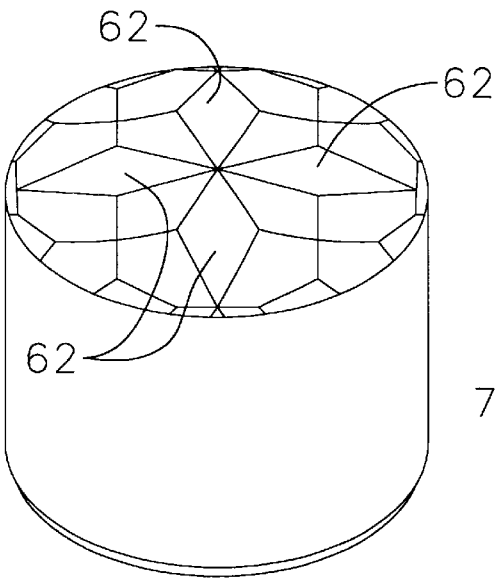
FIG. 8A is a perspective view of the substrate another embodiment cutting element of the present invention.

FIGS. 8A and 8B disclose a second exemplary embodiment cutting element substrate interface surface. The interface comprises a first set of four diamond shaped depressions 62 each having a central longitudinal axis 64 and extending radially from the center of the interface surface 12. Each of the four diamond shaped depressions is symmetric about its longitudinal axis 64 and about an axis 66 perpendicular to the longitudinal axis. The longitudinal central axes 62 of the four diamond shaped depressions are spaced at 90° increments. A second set of diamond shape depressions 68 is also formed on the interface surface. Each diamond shaped depression 68 of the second set is symmetric about its longitudinal central axis 70 and is formed between two consecutive first set diamond shaped depressions 62 such that it shares two of its perimeter side with the two first set depressions 62. Each of the second set diamond depressions 68 is not symmetric about an axis 74 perpendicular to the longitudinal central axis 70 of such depressions.

Figure 9:
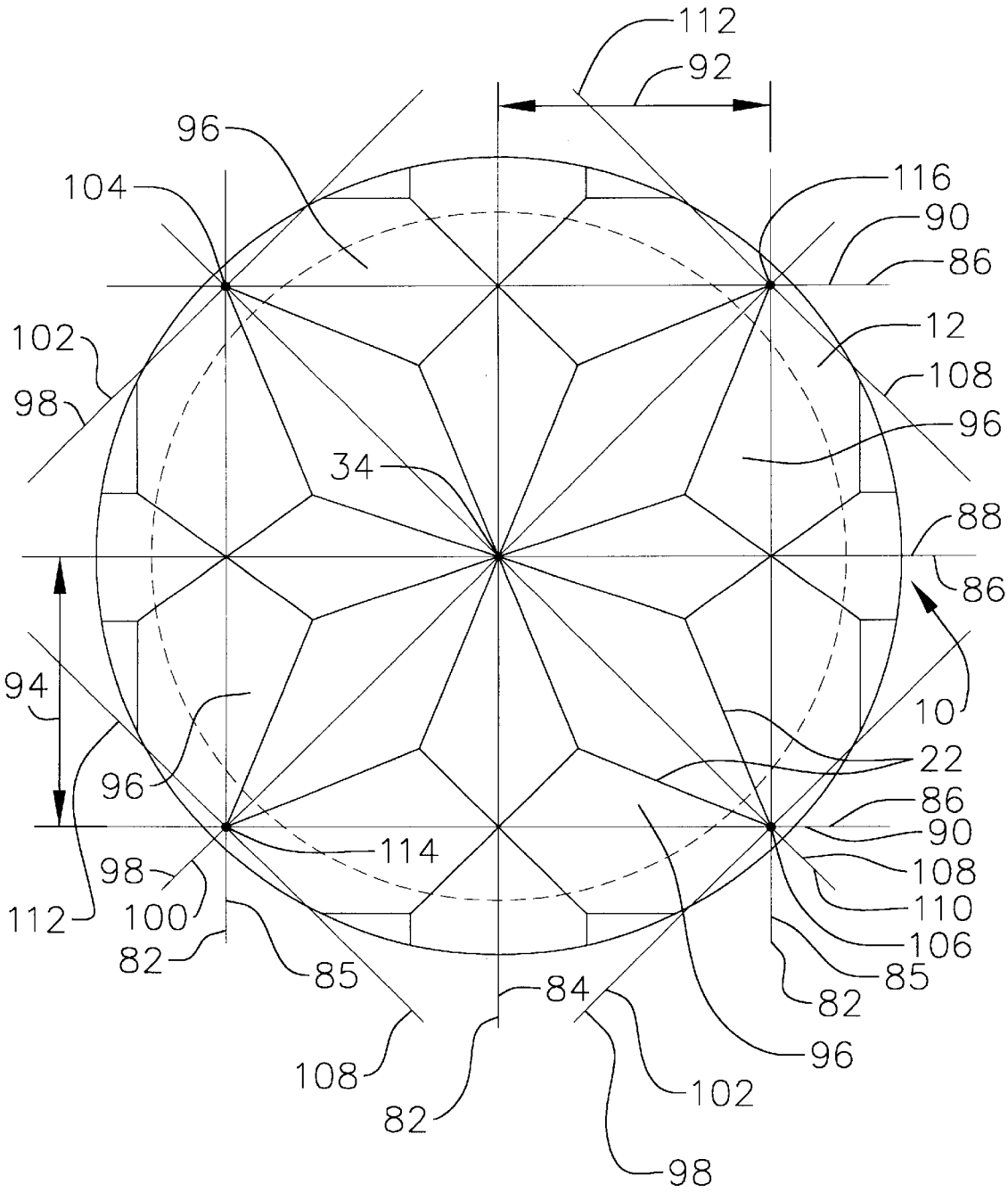
FIG. 9 is a top view of the cutting element substrate shown in FIG. 7A depicting the abutting shallow depressions formed thereon and further depicting the cutting tool paths for forming the depicted shallow depressions.

Eight pentagonal shaped depressions 76 are formed such that each pentagonal shaped depression shares one perimeter side with a first set and one perimeter side with a second set depression. Each pentagonal shaped depression has five vertices and shares one vertex 78 with a second pentagonal shaped depression and a second vertex 80 with a third pentagonal shaped depression. To form the substrate interface surface of the second exemplary embodiment shown in FIG. 8B, a first set three cuts are made using a milling tool across the interface surface 12 of the cutting element substrate 10 (FIG. 9). The first set of three cuts are made along paths 82. A central path 84 of the first set of paths 82 extends along a diameter of the cutting element substrate and thus intersects the central axis 34 of the cutting element. The other two end paths 85 are parallel and equidistantly spaced apart from either side of the central path 84.

A second set of cuts are made along a second set of paths 86 perpendicular to the first set of paths 82. The second set of paths include a central path 88 along a diameter of the cutting element substrate and two end paths 90 equidistantly spaced apart from either side of the central path 88. The distance 92 between two consecutive paths 82 of the first set is the same as the distance 94 between two consecutive paths 86 of the second set of paths. Consequently, four identical squares 96 are defined by the intersection of the two sets of paths.

A third set of three cuts are made at 45° to the first and second sets of cuts. The third set of cuts are made along a third set of parallel paths 98. A third set central path 100 extends along a diameter of the cutting element. Two end paths 102 are parallel to the central path 100 and are equidistantly spaced apart from the central path 100. Each of the end paths 102 of the third set intersect a point of intersection 104 or 106 between the end paths 85 and 90 of the first and second sets of paths.

A fourth set of three cuts are made perpendicular to the third set of cuts along a fourth set of three parallel paths 108 which are perpendicular to the third set of paths. A central path 110 of the fourth set of paths extends along a diameter of the cutting element. Two end paths 112 of the fourth set of paths are parallel to the central path 110 and equidistantly spaced from it. Each of the end paths 112 intersect a point of intersection 114 or 116 between the end paths 85 and 90 of the first and second set of paths. Each cut from any set, intersects a cut from each of the other sets at the same location. Each cut should be wide enough such that parallel adjacent cuts from the same set overlap each other so as to define the perimeter sides 22 of the depressions.

To ensure that a thicker portion of the cutting layer makes contact with the earth formations during drilling, it is preferred that the depressions are formed by milling a convex axis-symmetric interface surface while keeping the depth of each milling tool cut constant. Alternatively, the depth of each cut can be varied such that the thickness of each cut increases in a direction toward the periphery of the substrate. In such case, the substrate may have a flat, concave, or convex interface surface. In a preferred embodiment the depths of the cuts are symmetric about a plane perpendicular to the longitudinal direction of the cuts.

Figure 10:
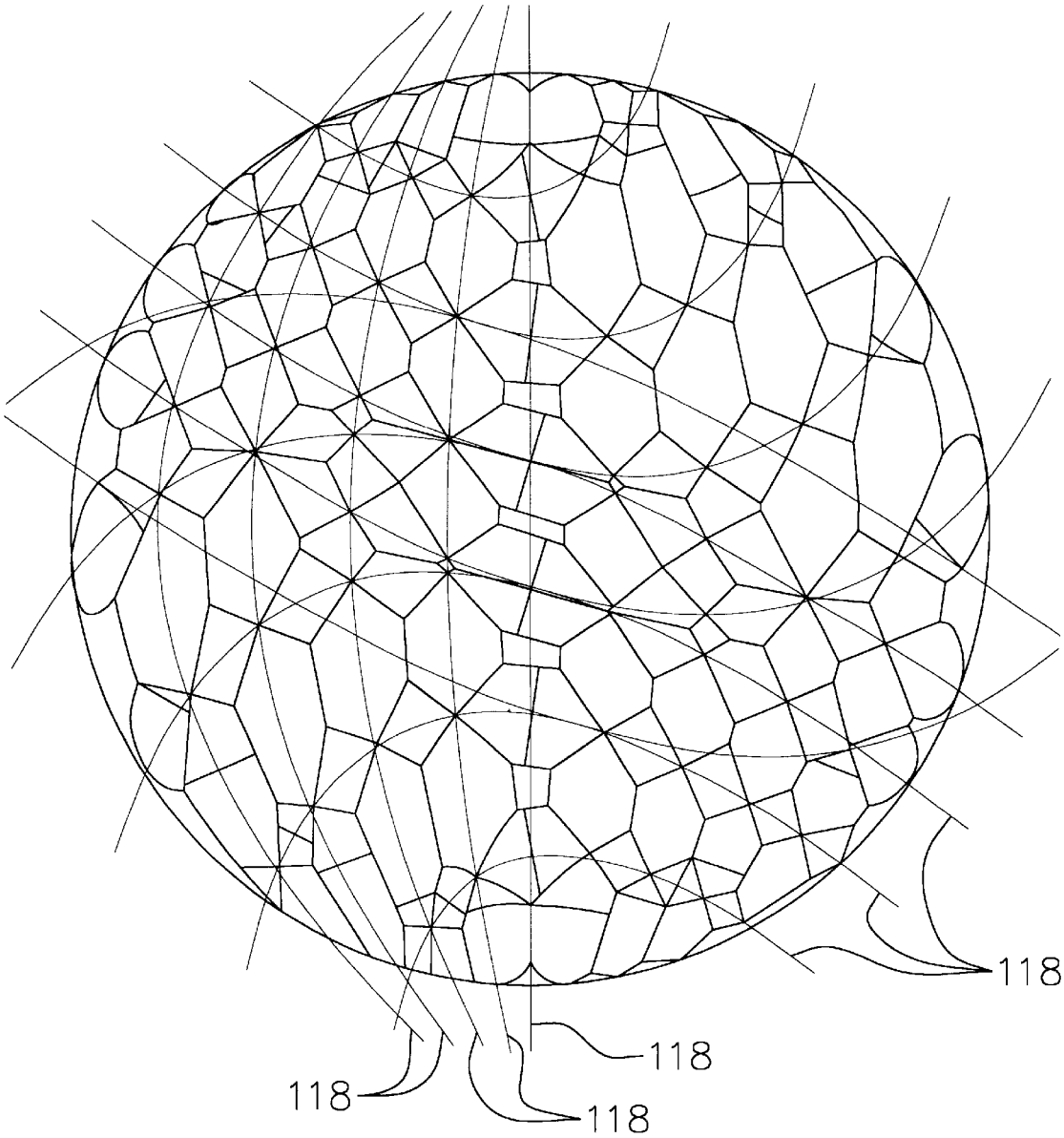
FIG. 10 is a top view of a further alternate embodiment cutting element substrate depicting the abutting shallow depressions formed thereon and further depicting the cutting tool paths for forming the depicted shallow depressions.

Different patterns of abutting shallow depressions may be formed by using different cutting paths as for example, the paths 118 shown in FIG. 10. In preferred embodiments, the patterns of shallow abutting depressions are symmetric about any diameter of the substrate interface surface. Moreover, by using such a symmetric pattern of shallow depressions, a cutting element can be reused after wearing by rotating it by 90° or 180°. In this regard, an unworn portion of the cutting element is brought in position to make contact with the earth formations during drilling without changing the depression pattern adjacent to the edge of the substrate coincident with the critical edge.

Instead of milling the depressions on the substrate directly, in a preferred embodiment, a cylindrical electrode blank having an end surface is formed using any of the well known methods and materials and the depressions are milled on the blank end surface. A typical electrode blank for example may be made from copper or graphite. Prior to milling, the blank end surface may be flat, convex or concave. The end surface of the blank is milled, as described above in relation with the milling of the substrates, along the patterns described above to form the above described depressions in the blank end face. In other words, the milled blank end surface has the shape of the desired substrate end surface with the desired depressions. The milled blank is then used to form a dye complementary to the blank which serves as a negative for forming the desired substrate having a shape complementary to the dye. Forming the dye may be accomplished by plunging the milled electrode blank into the dye material. The electrode blank serves as a cathode while the dye material serves as the anode. As the milled electrode blank is moved closer to the dye during plunging, the dye material erodes away forming a negative of the blank in the dye material, i.e., forming a dye. The substrate is formed using the dye using any of the well known methods, e.g., sintering of carbide powder. In alternate embodiments, the dye is used to form a substrate with at least a transition layer having the desired depressions.

Figure 11B:
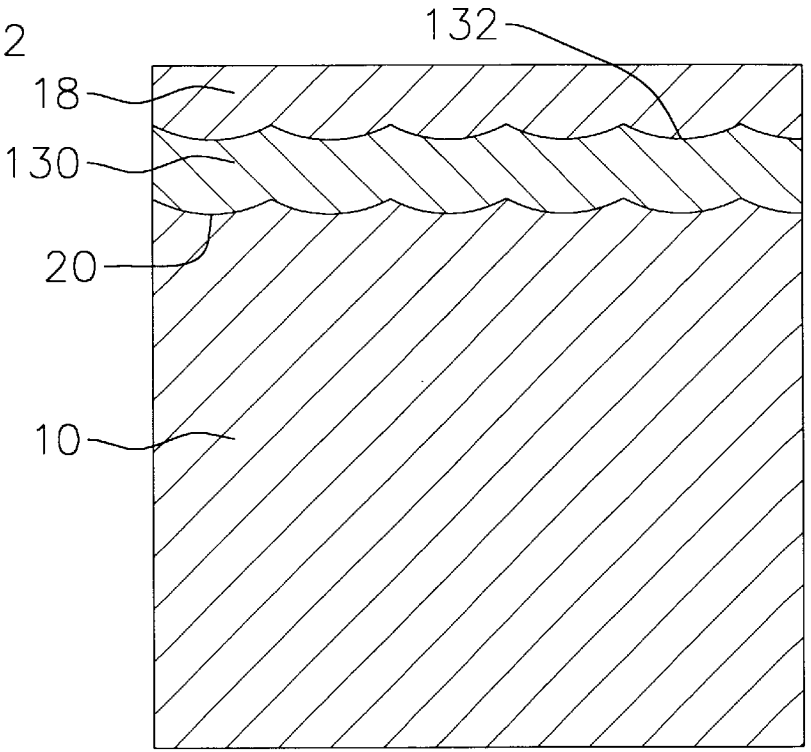
FIGS. 11A and 11B are cross-sectional views of cutting elements of the present invention incorporating a transition layer.
Figure 11A:
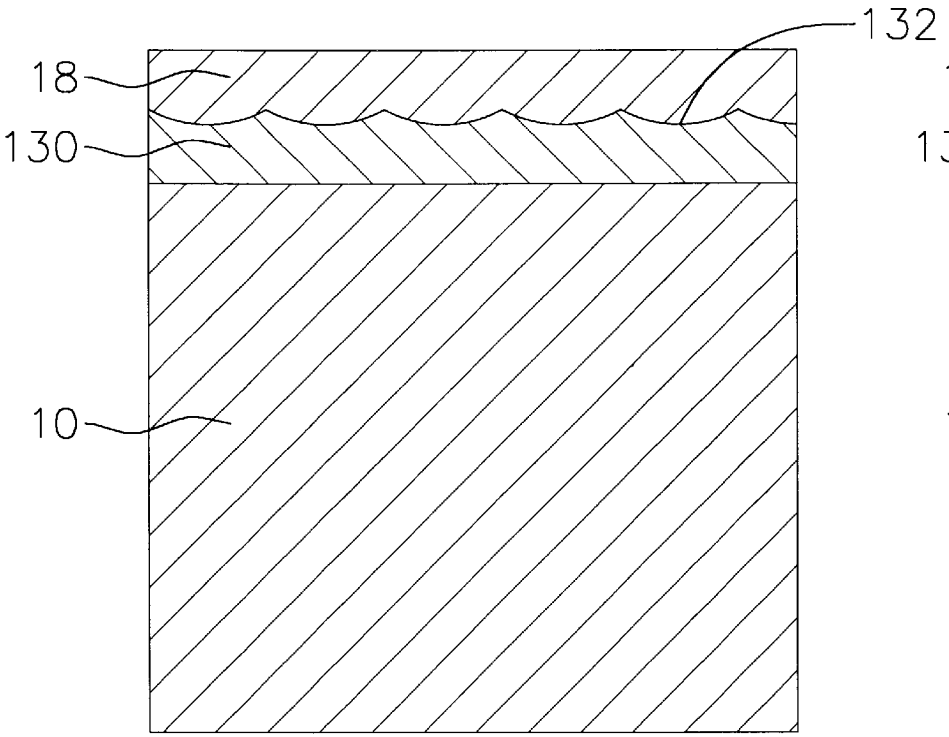

In other embodiments, a transition layer 130 may be formed between the substrate 10 and the ultra hard material layer 18 (FIG. 11A). The transition layer, preferably was properties intermediate between the properties of the substrate and the ultra hard material layer. In this regard, the transition layer provides for a more gradual shifting in the properties when moving axially from the substrate to the ultra hard material layer. Consequently, the magnitude of the residual stresses formed on the interface between the ultra hard material layer and the transition layer, or formed between the transition layer and the substrate are reduced in comparison to the magnitude of the residual stresses formed when the ultra hard material layer is directly bonded on the substrate.

In one embodiment, instead of forming the shallow depressions on the interface surface of the substrate, the shallow depressions are formed on the surface 132 of the transition layer interfacing with the ultra hard material layer 18. The shallow depressions formed on the transition layer may be formed prior to bonding of the ultra hard material layer. These depressions may be formed by machining after formation of the transition layer using a milling tool as described above. Alternatively, the shallow depressions may be formed by forming the transition layer in a mold defining the depressions.

Furthermore, the transition layer may be in the form of a tape or sheet material such as a high sheer compaction sheet. The shallow depressions may be formed on the tape or sheet material by pressing, as for example by embossing.

In an alternative embodiment shown in FIG. 11B, the transition layer is draped within the shallow depressions 20 formed of a substrate interface surface. Consequently, depressions are also formed on the surface 132 of the transition layer which will interface with the ultra hard material layer. With this embodiment, preferably the transition layer in the form of a tape or sheet material. With any of the aforementioned embodiments, more than one transition layer may be incorporated.

Although the present invention has been described and illustrated to respect to multiple embodiments thereof, it is to be understood that it is not to be so limited, since changes and modifications may be made therein which are within the full intended scope of this invention as hereinafter claimed.

What is claimed is:

1. A cutting element comprising:

a body having a diameter and an end face having a periphery;

a plurality of abutting depressions formed on at least a majority of the end face, each depression of said plurality of depressions being abutted by at least three other depressions of said plurality of depressions; and an ultra hard material layer over the end face.

2. A cutting element as recited in claim 1 wherein the maximum depth of each depression as measured from the perimeter of the depression is not greater than 5% of the diameter of the body.

3. A cutting element as recited in claim 1 wherein the maximum depth of each depression is not less than 0.5% of the diameter of the body.

4. A cutting element as recited in claim 1 wherein the abutting depressions span the entire end surface.

5. A cutting element as recited in claim 1 wherein the depressions have a polygonal shape when viewed from an axial direction relative to the body.

6. A cutting element as recited in claim 1 wherein at least some of the depressions have a quadrilateral shaped when viewed from an axial direction relative to the body.

7. A cutting element as recited in claim 1 wherein at least some of the depressions have a pentagonal shape when viewed from an axial direction relative to the body.

8. A cutting element as recited in claim 1 further comprising a plurality of diamond shaped depressions formed on the end face, wherein each diamond shaped depression comprises a longitudinal central axis, wherein the longitudinal central axis of each the diamond shaped depressions is aligned with a diameter of the body.

9. A cutting element as recited in claim 8 wherein said diamond shaped depressions have their central longitudinal axes aligned along the same diameter of the body.

10. A cutting element as recited in claim 1 wherein at least some of the depressions extend to the periphery of the body.

11. A cutting element as recited in claim 1 wherein the depression are form a pattern on the end face, the pattern being symmetric about a diameter of the body.

12. A cutting element as recited in claim 1 further comprising a transition layer between the body and the ultra hard material layer.

13. A cutting element as recited in claim 1 further comprising a transition layer between the body and the ultra hard material layer, wherein the transition layer comprises a surface interfacing with the ultra hard material layer and wherein the transition layer interface surface comprises a pattern of depressions complementary to the depressions formed on the body end face.

14. A cutting element as recited in claim 1 wherein the depth of a depression closest to the periphery as measured from a plane perpendicular to the central axis of the body is greater than the depth of another depression further from the periphery as measured from the same plane.

15. A cutting element as recited in claim 1 wherein each of the plurality of abutting depressions is abutted by at least four other depressions of said plurality of depressions.

16. A cutting element comprising:

a body having a diameter and an end face having a periphery;

a transition layer formed over the end face, the transition layer having first face closest to the end face and a second face opposite the first face;

a plurality of abutting depressions formed on the first face, each depression being abutted by at least two other depressions; and an ultra hard material layer over the first face.

17. A cutting element as recited in claim 16 wherein the maximum depth of each depression as measured from the perimeter of the depression is not greater than 5% of the diameter of the body.

18. A cutting element as recited in claim 16 wherein the maximum depth of each depression is not less than 0.5% of the diameter of the body.

19. A cutting element as recited in claim 16 wherein the depressions have a polygonal shape when viewed from an axial direction relative to the body.

20. A method for forming a cutting element comprising the steps of:

forming a substrate having a periphery, a longitudinal central axis and an end face;

forming a plurality of abutting depressions on at least a majority of the end face, wherein each depression of said plurality of depressions is abutted by at least three other depressions of said plurality of depressions; and forming an ultra hard material layer over the end face.

21. A method as recited in claim 20 wherein the step of forming the plurality of abutting depressions comprises:

making a first set of parallel cuts across the end face, wherein one cut intersects the longitudinal central axis of the substrate;

making a second set of parallel cuts perpendicular to the first set of cuts, wherein one of the second set cuts intersects the center of the substrate;

making a third set of parallel cuts at a 45° angle to the first set of cuts, wherein one of the third set cuts intersects the center of the substrate; and making a fourth set of parallel cuts perpendicular to the third set of parallel cuts, wherein one of the fourth set cuts intersects the center of the substrate.

22. A method for forming a cutting element comprising the steps of:

forming a substrate having a periphery, a longitudinal central axis and an end face and a plurality of abutting depressions on at least a majority of the end face, wherein each depression is abutted by at least three other depressions; and forming an ultra hard material layer over the end face.

23. A method as recited in claim 22 wherein the step of forming the substrate comprises:

forming a blank having an end face, a periphery and a central longitudinal axis;

making a first set of parallel cuts across the blank end face, wherein one cut intersects the longitudinal central axis of the blank;

making a second set of parallel cuts perpendicular to the first set of cuts, wherein one of the second set cuts intersects the central longitudinal axis of the blank;

making a third set of parallel cuts at a 45° angle to the first set of cuts, wherein one of the third set cuts intersects the central longitudinal axis of the blank; and making a fourth set of parallel cuts perpendicular to the third set of parallel cuts, wherein one of the fourth set cuts intersects the central longitudinal axis of the substrate;

forming a dye complementary to the blank; and forming the substrate using the dye wherein the substrate is complementary to the dye.

24. A method as recited in claim 23 wherein the spacing between the first set of cuts is equal to the spacing between the second set of cuts.

25. A method as recited in claim 24 wherein the spacing between the third set of cuts is equal to the spacing between the fourth set of cuts.

26. A method as recited in claim 25 wherein each cut from each set intersects a cut from each of the other sets at the same location.

27. A method as recited in claim 24 wherein the blank is an electrode.

28. A method as recited in claim 23 wherein the depth of each cut as measured from the end face is constant throughout the cut.

29. A method as recited in claim 23 wherein the depth of each cut as measured from the end face increases in a direction toward the periphery of the blank.

30. A method as recited in claim 23 wherein the step of forming the blank comprises forming the blank having a convex end face.

31. A method as recited in claim 23 wherein the step of forming a plurality of abutting depressions comprises forming a plurality of abutting depressions forming a pattern on the end face that is axis-symmetric about the blank longitudinal central axis.

32. A method as recited in claim 23 wherein the maximum depth of each depression as measured from a highest point on the end face increases for depressions closest to the periphery.

33. A cutting element comprising:

a body having a diameter and an end face having a periphery;

a plurality of abutting depressions formed on the end face, each depression of said plurality of depressions being abutted by at least two other depressions of said plurality of depressions, wherein the maximum depth of each depression as measured from the perimeter of the depression is not greater than 5% of the diameter of the body; and an ultra hard material layer over the end face.

34. A cutting element comprising:

a body having a diameter and an end face having a periphery;

a plurality of abutting depressions formed on the end face, each depression of said plurality of depressions being abutted by at least two other depressions of said plurality of depressions, wherein the maximum depth of each depression is not less than 0.5% of the diameter of the body; and an ultra hard material layer over the end face.

35. A cutting element comprising:

a body having a diameter and an end face having a periphery;

a plurality of abutting depressions formed on the end face, each depression of said plurality of depressions being abutted by at least two other depressions of said plurality of depressions, wherein the depressions have a polygonal shape when viewed from an axial direction relative to the body; and an ultra hard material layer over the end face.

36. A cutting element as recited in claim 35 wherein the abutting depressions span not less than 20% of the end face surface area.

37. A cutting element comprising:

a body having a diameter and an end face having a periphery;

a plurality of abutting depressions formed on the end face, each depression of said plurality of depressions being abutted by at least two other depressions of said plurality of depressions, wherein at least some of the depressions have a quadrilateral shape when viewed from an axial direction relative to the body; and an ultra hard material layer over the end.

38. A cutting element comprising:

a body having a diameter and an end face having a periphery;

a plurality of abutting depressions formed on the end face, each depression of said plurality of depressions being abutted by at least two other depressions of said plurality of depressions, wherein at least some of the depressions have a pentagonal shape when viewed from an axial direction relative to the body; and an ultra hard material layer over the end face.

39. A cutting element as recited in claim 38 wherein said diamond shaped depressions have their central longitudinal axes aligned along the same diameter of the body.

40. A cutting element comprising:

a body having a diameter and an end face having a periphery;

a plurality of abutting depressions formed on the end face, each depression of said plurality of depressions being abutted by at least two other depressions of said plurality of depressions;

a plurality of diamond shaped depressions formed on the end face, wherein each diamond shaped depression comprises a longitudinal central axis, wherein the longitudinal central axis of each the diamond shaped depressions is aligned with a diameter of the body; and an ultra hard material layer over the end face.

41. A cutting element comprising:

a body having a diameter and an end face having a periphery;

a plurality of abutting depressions formed on the end face, each depression of said plurality of depressions being abutted by at least two other depressions of said plurality of depressions;

an ultra hard material layer over the end face; and a transition layer between the body and the ultra hard material layer.

42. A cutting element comprising:

a body having a diameter and an end face having a periphery;

a plurality of abutting depressions formed on the end face, each depression of said plurality of depressions being abutted by at least two other depressions of said plurality of depressions;

an ultra hard material layer over the end face; and a transition layer between the body and the ultra hard material layer, wherein the transition layer comprises a surface interfacing with the ultra hard material layer and wherein the transition layer interface surface comprises a pattern of depressions complementary to the depressions formed on the body end face.

43. A method for forming a cutting element comprising the steps of:

forming a substrate having a periphery, a longitudinal central axis and an end face;

forming a plurality of abutting depressions on the end face, wherein each depression of said plurality of depressions is abutted by at least two other depressions of said plurality of depressions, said forming a plurality of abutting depressions comprising, making a first set of parallel cuts across the end face, wherein one cut intersects the longitudinal central axis of the substrate, making a second set of parallel cuts perpendicular to the first set of cuts, wherein one of the second set cuts intersects the center of the substrate, making a third set of parallel cuts at a 45° angle to the first set of cuts, wherein one of the third set cuts intersects the center of the substrate, and making a fourth set of parallel cuts perpendicular to the third set of parallel cuts, wherein one of the fourth set cuts intersects the center of the substrate; and forming an ultra hard material layer over the end face.

44. A method for forming a cutting element comprising the steps of:

forming a substrate having a periphery, a longitudinal central axis and an end face and a plurality of abutting depressions on the end face, wherein each depression is abutted by at least two other depressions, said forming a substrate comprising, forming a blank having an end face, a periphery and a central longitudinal axis, making a first set of parallel cuts across the blank end face, wherein one cut intersects the longitudinal central axis of the blank, making a second set of parallel cuts perpendicular to the first set of cuts, wherein one of the second set cuts intersects the central longitudinal axis of the blank, making a third set of parallel cuts at a 45° angle to the first set of cuts, wherein one of the third set cuts intersects the central longitudinal axis of the blank, and making a fourth set of parallel cuts perpendicular to the third set of parallel cuts, wherein one of the fourth set cuts intersects the central longitudinal axis of the substrate;

forming a dye complementary to the blank, and forming the substrate using the dye wherein the substrate is complementary to the dye; and forming an ultra hard material layer over the end face.

* * * * *